US012156601B1

(12) United States Patent
Proshinovsky

(10) Patent No.: US 12,156,601 B1
(45) Date of Patent: Dec. 3, 2024

(54) HANGER SYSTEM

(71) Applicant: BEST AT A GLANCE INC, Spring Valley, NY (US)

(72) Inventor: Aharon Proshinovsky, Spring Valley, NY (US)

(73) Assignee: BEST AT A GLANCE INC, Spring Valley, NY (US)

( * ) Notice: Subject to any disclaimer, the term of this patent is extended or adjusted under 35 U.S.C. 154(b) by 0 days.

(21) Appl. No.: 18/594,126

(22) Filed: Mar. 4, 2024

Related U.S. Application Data

(63) Continuation of application No. 18/590,317, filed on Feb. 28, 2024, which is a continuation-in-part of application No. 18/445,669, filed on Aug. 17, 2023.

(51) Int. Cl.
*A47G 25/34* (2006.01)

(52) U.S. Cl.
CPC ..... *A47G 25/34* (2013.01)

(58) Field of Classification Search
CPC ..... A47G 25/1442; A47G 25/145; A47G 25/1464; A47G 25/34
See application file for complete search history.

(56) References Cited

U.S. PATENT DOCUMENTS

2003/0222108 A1* 12/2003 Gouldson ..... A47G 25/485 223/91
2015/0297012 A1* 10/2015 Yamada ..... A47G 25/20 223/85
2017/0020320 A1* 1/2017 Prats ..... G09F 1/00

OTHER PUBLICATIONS

Utopia Home Clothes Hangers 30 Pack—Plastic Hangers Space Saving—Durable Coat Hanger with Shoulder Grooves—Skirt Hangers—(White) / https://www.amazon.com/dp/B0B2LLVCN7?th=1 (accessed Feb. 15, 2024).
Sharpty—Plastic Hangers—Adult Clothes Hangers—T-Shirt, Dress, Coat Hangers & Accessories—Heavy Duty Hangers—Notched Hanger, Durable & Versatile Color Clothing Closet Hanger(20-Pack, White) / https://www.amazon.com/dp/B07FP199PF?th=1 (accessed Feb. 15, 2024).
Mainstays Clothing Hangers, 50 Pack, White, Durable Plastic / https://www.walmart.com/ip/seort/1885786932 (accessed Feb. 15, 2024).

* cited by examiner

*Primary Examiner* — Nathan E Durham
(74) *Attorney, Agent, or Firm* — Koffsky Schwalb LLC; Mark I. Koffsky

(57) ABSTRACT

A hanger that is shaped to reduce packaging size by 30-50% is described. The amount of air in hanger packaging is minimized because each hanger has a "groove" that allows another hanger to sit on top as a "tongue" and save space. This significantly reduces the shipping cost of a set of hangers, while maintaining its utility as a hanger when in use.

7 Claims, 4 Drawing Sheets

HANGER SYSTEM

RELATED APPLICATION

This application claims the benefit of the following application, which is incorporated by reference in its entirety: U.S. Provisional Application 63/533,233, filed on Aug. 17, 2023. A petition to convert this provisional application to a nonprovisional application under 37 C.F.R. § 1.53 (c) (3) has been filed.

FIELD OF THE DISCLOSURE

The present disclosure relates generally to an improved mechanism for the use and packing of a hanger for efficient shipping that also maintains integrity of the hanger.

BACKGROUND

Due to the unique shape of hangers, packages including hangers for shipment are mostly filled with air. This results in higher than necessary freight charges despite the hangers themselves occupying little space within the packaging. In fact, the cost of shipping per set of hangers is so expensive that hangers at "brick and mortar" stores tend to be cheaper than hangers purchased online since shipping to customers is not required for "brick and mortar" stores.

The challenge of designing a hanger to resolve this issue includes ensuring that the hanger can both be packed efficiently in pairs and maintain their utility to hang clothes properly without warping or collapsing. There is also a design challenge to reduce any additional plastic material beyond the standard hanger design so that the hangers are still cheap to manufacture. Therefore, there is a need to design a hanger that may be more efficiently packed into packaging while maintaining its utility as a hanger when in use.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention and explain various principles and advantages of those embodiments.

Figure 1A:
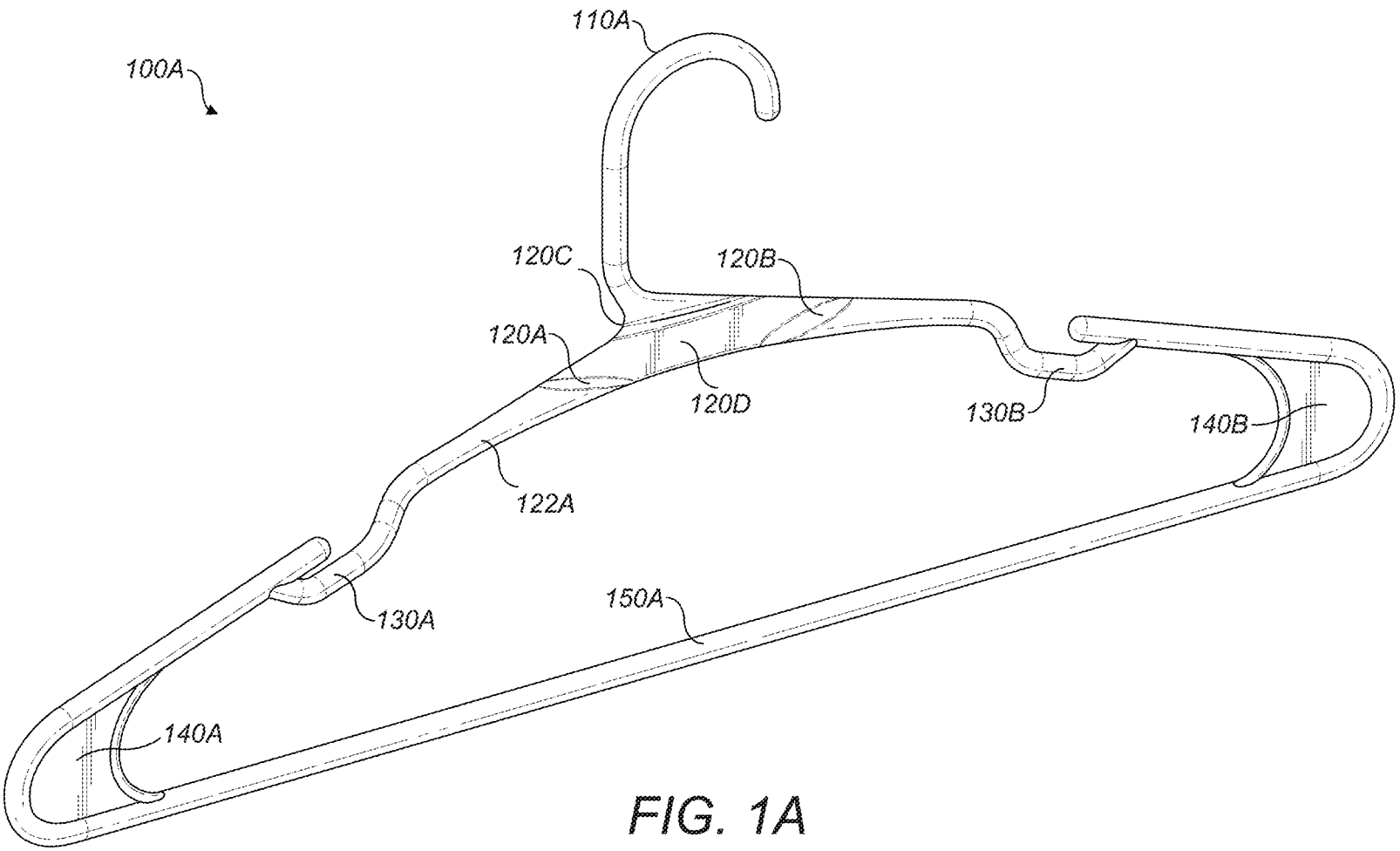
FIG. 1A shows the front view of a single hanger.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

The hanger design described herein allows the amount of air in the shopping box to be minimized because each hanger has a groove that allows another hanger to sit on top and save space. This significantly reduces the shipping costs of a set of hangers.

Each hanger has a thinner part strategically located in the top center of the hanger and added additional support on the sides so that the hanger does not lose its structural strength. This thinner part allows each hanger to accept another hanger on top of it without adding more space to the height or width of the packaging, resulting in a much smaller overall package size.

Turning to FIG. 1A, shown is a view of the front side of a single hanger 100A. The hanger includes a hook 110A attached to a hanger top portion 122A, which is attached to a hanger bottom portion 150A. The hanger may include strengthening side members 140A, 140B situated between the hanger top portion 122A and the hanger bottom portion 150A: this gives the hanger additional mechanical strength. The hanger top portion 122A may also include notches 130A, 130B that allow for additional functionality for the hanger. The notches 130A, 130B may be anti-slip and used for air drying, lingerie, and accessories.

At or about the center of the hanger top portion 122A, a quasi-trapezoid shaped depression 120D is surrounded by groove sides 120A, 120B, 120C, which collectively form a "groove." As will be shown below, a sub-portion of the top portion of a second hanger may act as a "tongue" to be securely nestled within the "groove."

After numerous iterations, it was found that creating a quasi-trapezoid shaped depression at or about the center of the hanger top portion was the ideal method to thin this part of the hanger without creating too weak of a point that renders the hanger useless. It was also found that the strengthening side members added further robustness to the hanger design, thereby compensating for any weakness produced by the depression at or about the center of the hanger top portion.

Figure 1B:
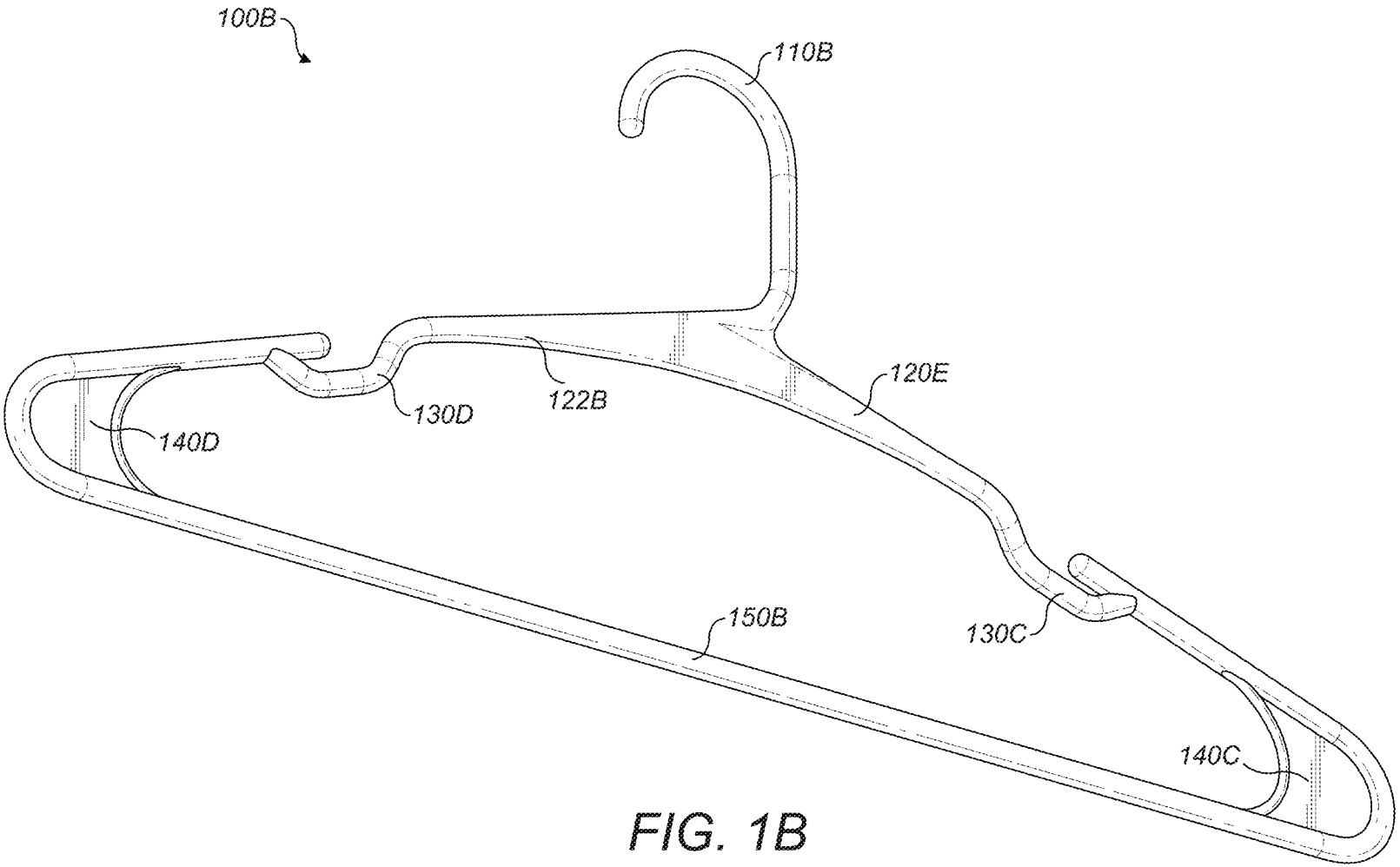
FIG. 1B shows the back view of a single hanger.

Turning to FIG. 1B, shown is a view of the back side of a single hanger 100B. The hanger includes a hook 110B attached to a hanger top portion 122B, which is attached to a hanger bottom portion 150B. The hanger may include strengthening side members 140D, 140C situated between the hanger top portion 122B and the hanger bottom portion 150B: this gives the hanger additional mechanical strength. The hanger top portion 122B may also include notches 130D, 130C that allow for additional functionality for the hanger. The notches 130C, 130D may be anti-slip and used for air drying, lingerie and accessories.

The hanger top portion 122B includes a top sub-portion 120E that is situated on the reverse side of the hanger top portion 122A where the quasi-trapezoid shaped depression 120D is surrounded by groove sides 120A, 120B, 120C. As will be shown below, this top sub-portion 120E of this hanger may be securely nestled as a "tongue" within the "groove" construction of a second hanger.

Figure 2:
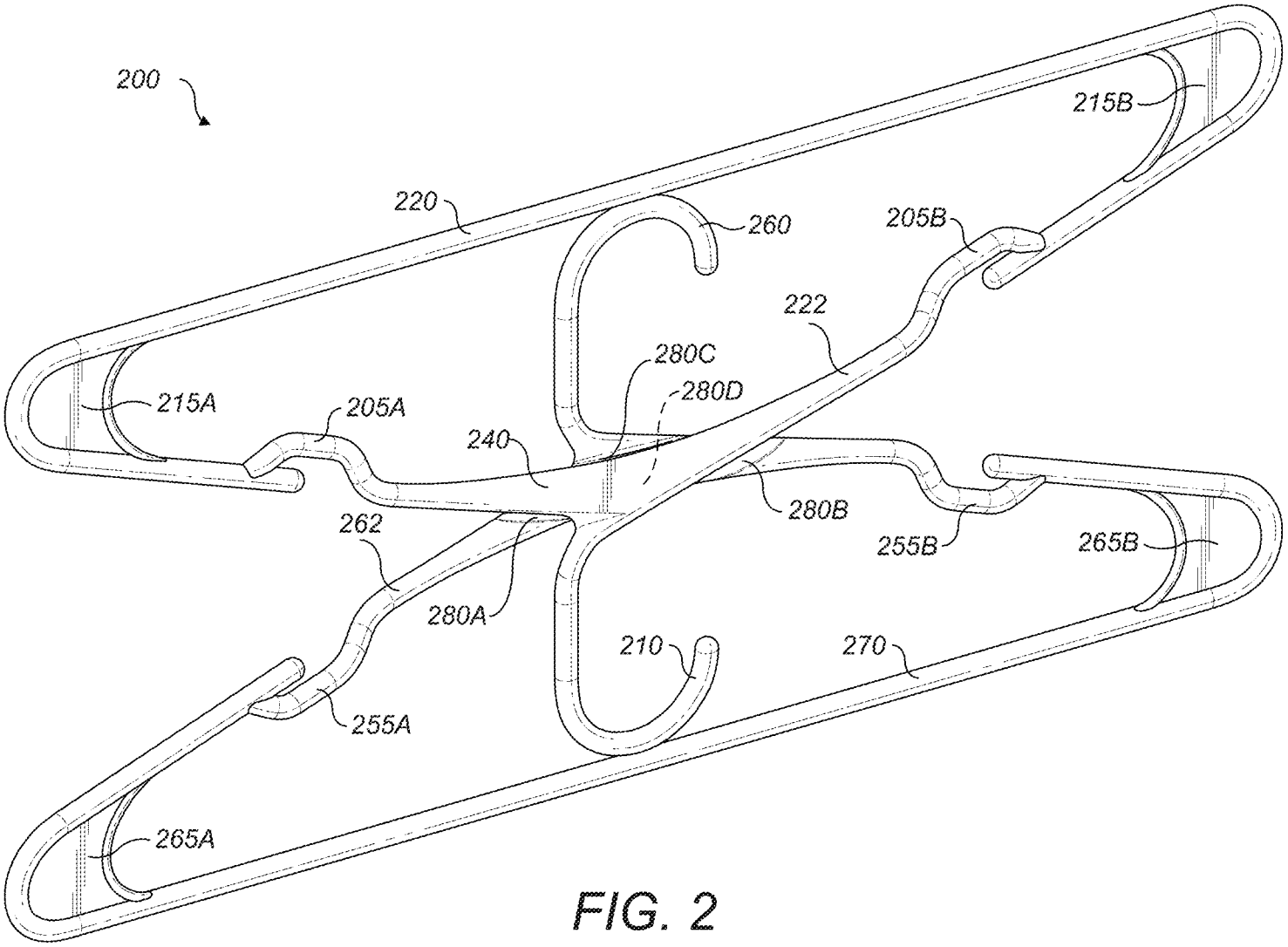
FIG. 2 shows a combination of two hangers where the back of the upper hanger is overlaid onto, and coupled within, the front of the lower hanger.

Turning to FIG. 2, shown is a combination of two hangers where the back of the upper hanger is overlaid onto the front of the lower hanger 200. The upper hanger includes an upper hook 210 attached to an upper hanger top portion 222, which is attached to an upper hanger bottom portion 220. The upper hanger may include upper strengthening side members

215A, 215B situated between the upper hanger top portion 222 and the upper hanger bottom portion 220; this gives the upper hanger additional mechanical strength. The upper hanger top portion 222 may also include notches 205A, 205B that allow for additional hanging functionality for the hanger.

The lower hanger includes a lower hook 260 attached to a lower hanger top portion 262, which is attached to a lower hanger bottom portion 270. The lower hanger may include lower strengthening side members 265A, 265B situated between the lower hanger top portion 262 and the lower hanger bottom portion 270; this gives the lower hanger additional mechanical strength. The lower hanger top portion 262 may also include notches 255A, 255B that allow for additional functionality for the hanger.

In FIG. 2, the upper hanger may be secured within the lower hanger via a "tongue-in-groove" configuration. Specifically, the upper hanger top sub-portion 240 is placed as a "tongue" within the "groove" of the lower hanger formed by combination of the quasi-trapezoid shaped depression 280D (not shown as it is covered by the sub-portion 240) surrounded by the groove sides 280A, 280B, 280C.

The quasi-trapezoid shaped depression shape of the "tongue and grove" design and where it is located may contribute to lessened structural support within the hanger. By strategically adding additional material to the sides of the hanger structure, the structural integrity of the hanger may be increased to offset any loss of structural integrity resulting from the quasi-trapezoid shaped depression shape.

The shape of the depression and groove sides within the hanger may be altered to accommodate a different shape of a top sub-portion of a paired hanger.

Using this "tongue and groove" placement concept, packaging size may be reduced by approximately 30-35% while still maintaining the sturdiness of the structure.

In one embodiment, when two hangers are placed together: (a) the top of the hook of the upper hanger 210 touches the top of the bottom portion of the lower hanger 270; and (b) the top of the hook of the lower hanger 260 touches the top of the bottom portion of the lower hanger 220.

In one embodiment, the material of a hanger comprises one or more of flexible plastic, inflexible plastic, wood, metal, cloth, or a combination of the foregoing.

In one embodiment, the notches on the top portion of the hanger may be of an S-shape, V-shape not present at all, or a combination of the foregoing.

In one embodiment, the strengthening side portions comprises one or more of a curved side profile, a straight side profile, or a combination of the foregoing.

In one embodiment, a hanger profile comprises one or more of squared corners, rounded corners, or a combination of the foregoing.

In one embedment, the two hangers may further be secured by magnetism, adhesives, a hook and loop faster system, or a combination of the foregoing.

The hanger may be used to organize and store tops, shirts, pants, skirts, dresses, suits, shawls, coats and more. The hangers may maximize space due to their slim, space saving design and customers may enjoy the clean, calming effect on their closets.

The hangers may be constructed from heavy duty, non-breakable plastic, with a tubular, smooth body that ensures no sharp corners that rip the garments. The hangers may be flexible for lightweight clothing and durable enough for heavier clothing.

The hanger may measure 15.9"×7.4"×0.22".

Figure 3B:
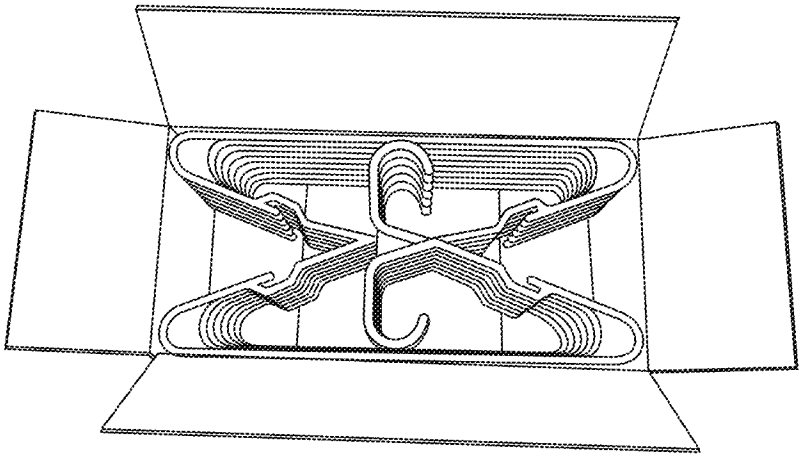
FIG. 3B shows a packing system of 20 hangers disclosed in this application.
Figure 3A:
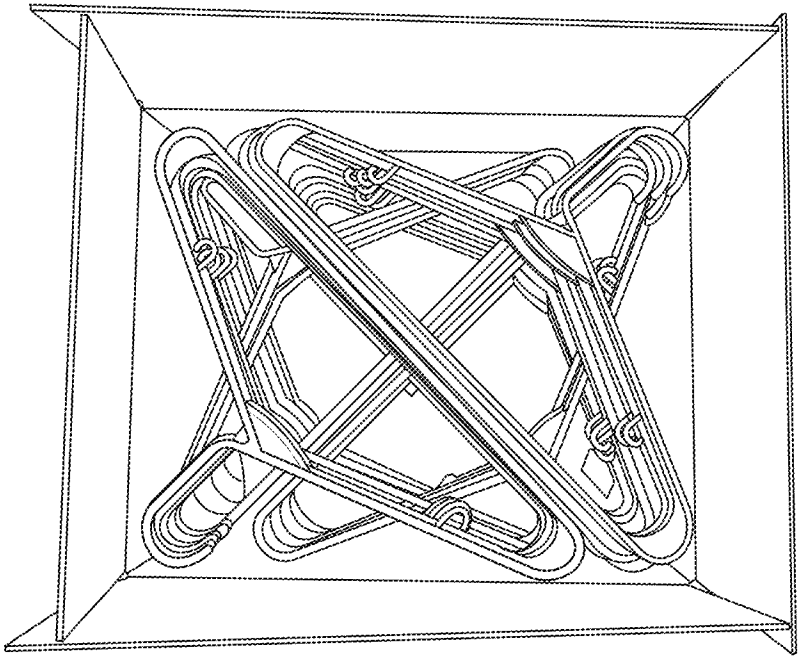
FIG. 3A PRIOR ART
FIG. 3A shows a packing system of 20 prior art hangers.

Turning to FIG. 3A, shown is a packing system 300 of 40 prior art hangers. Because of the shape of the prior art hangers, this packing system results in a large amount of unused space, resulting in increased shipping costs.

Turning to FIG. 3B, shown is a packing system 350 of 40 of the hangers disclosed in this application. Because of the unique shape and ability to efficiently pack these hangers, this packing system results in a smaller amount of unused space, resulting in decreased shipping costs. In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description with each claim standing on its own as a separately claimed subject matter.

I claim:

1. A hanger system comprising:

a first hanger comprising:

a first hook, the first hook having a first hook bottom;

a first upper hanger portion that is connected to the first hook bottom and having a first front upper hanger portion, wherein the first upper hanger portion comprises a first left upper hanger portion and a first right upper hanger portion;

a first lower hanger portion that is connected to the first upper hanger portion, wherein the first lower hanger portion comprises a first left lower hanger portion and a first right lower hanger portion;

a first left strengthening side member attached to the first left upper hanger portion and the first left lower hanger portion;

a first right strengthening side member attached to the first right upper hanger portion and the first right lower hanger portion;

a quasi-trapezoid shaped depression centrally situated within the first front upper hanger portion and below the first hook bottom; and a second hanger comprising:

a second hook;

a second upper hanger portion that is connected to the second hook and having a second back upper hanger portion, wherein the second upper hanger portion comprises a second left upper hanger portion and a second right upper hanger portion;

a second lower hanger portion that is connected to the second upper hanger portion, wherein the second lower hanger portion comprises a second left lower hanger portion and a second right lower hanger portion;

a second left strengthening side member attached to the second left upper hanger portion and the second left lower hanger portion;

a second right strengthening side member attached to the second right upper hanger portion and the second right lower hanger portion;

wherein the second hanger is selectively coupled with the first hanger when a section of the second back upper hanger portion is inserted within the quasi-trapezoid shaped depression; and wherein the first hook touches the second lower hanger portion; and the second hook touches the first lower hanger portion.

2. The hanger system as in claim 1, wherein the quasi-trapezoid shaped depression includes groove sides.

3. The hanger system as in claim 2, wherein the quasi-trapezoid shaped depression includes three groove sides.

4. The hanger system as in claim 1, further comprising:

a first left notch within the first left upper hanger portion;

a first right notch within the first right upper hanger portion;

a second left notch within the second left upper hanger portion; and a second right notch within the second right upper hanger portion.

5. The hanger system as in claim 1, wherein the first hook, the first upper hanger portion, the first lower hanger portion, the second hook, the second upper hanger portion, and the second lower hanger portion are constructed with a tubular, smooth body.

6. The hanger system as in claim 1, wherein the quasi-trapezoid shaped depression results in a thinner hanger portion adjacent to the first hook bottom.

7. The hanger as in claim 1, wherein the first hanger has a first leftmost side and a first rightmost side;

wherein the first left strengthening side member is situated on the first leftmost side;

wherein the first right strengthening side member is situated on the first rightmost side;

wherein the second hanger has a second leftmost side and a second rightmost side;

wherein the second left strengthening side member is situated on the second leftmost side; and wherein the second right strengthening side member is situated on the second rightmost side.

* * * * *